US006705842B2

(12) United States Patent
Cacard

(10) Patent No.: US 6,705,842 B2
(45) Date of Patent: Mar. 16, 2004

(54) DYNAMIC ATTENUATOR OF DISCHARGE NOISE FROM ROTARY VACUUM MACHINES

(75) Inventor: Albert Cacard, Groisy (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/119,028

(22) Filed: Apr. 10, 2002

(65) Prior Publication Data

US 2002/0150472 A1 Oct. 17, 2002

(30) Foreign Application Priority Data

Apr. 12, 2001 (FR) ..... 01 05031

(51) Int. Cl.[7] ..... F04B 39/00; F16K 47/02

(52) U.S. Cl. ..... 417/312; 415/119; 418/206.4; 181/233

(58) Field of Search ..... 417/312, 410.4; 415/119, 181; 418/181, 206.4, 206.7; 181/209, 403, 237, 234, 233, 226

(56) References Cited

U.S. PATENT DOCUMENTS 1,746,885 A * 2/1930 Bunge et al. ..... 418/206.4
3,884,664 A * 5/1975 Edwards ..... 417/312
4,768,934 A * 9/1988 Soeters, Jr. ..... 418/1

FOREIGN PATENT DOCUMENTS

FR 1.203.244 A 1/1960
GB 910465 A 11/1962

* cited by examiner

*Primary Examiner*—Justine R. Yu
*Assistant Examiner*—Michael K. Gray
(74) *Attorney, Agent, or Firm*—Sughrue Mion, PLLC

(57) ABSTRACT

According to the invention, discharge noise from rotary vacuum machines having complementary profiles is attenuated by interposing between the discharge from the primary pump and the outlet to the atmosphere, a transfer device having independent cavities, e.g. cavities on a rotor rotated on a shaft, the cavities moving sequentially from the discharge to the outlet while simultaneously providing isolation between the discharge and the outlet. This achieves dynamic attenuation of the noise in a manner that is particularly simple and low cost, while also being very effective in suppressing discharge noise.

14 Claims, 6 Drawing Sheets

DYNAMIC ATTENUATOR OF DISCHARGE NOISE FROM ROTARY VACUUM MACHINES

The present invention relates to rotary vacuum machines comprising a primary pump having complementary profiles or implementing volume transfer.

BACKGROUND OF THE INVENTION

A drawback of such rotary vacuum machines with a primary pump having complementary profiles is that they produce discharge noise that can lead to inconvenience and discomfort when they are in use.

This discharge noise is due to the pressure difference between the inlet and the outlet of the atmospheric stage or outlet stage of the primary pump. Because of this pressure difference, and because the primary pump having complementary profiles acts at each stage by transferring volume and not by applying compression, shockwaves are produced when the low pressure volume transferred by the atmospheric stage finds itself suddenly exposed to the atmosphere. The outside gas at atmospheric pressure enters into the volume at high speed prior to being subsequently discharged by the pump. The opposition to movement of the two very fast gas flows gives rise to a shockwave which gives rise to loud bangs.

The phenomenon grows with increasing pressure difference between the inlet and the outlet of the pump, i.e. for example, during continuous operation with the vacuum machine maintaining a high vacuum inside an enclosure.

Attempts have been made to reduce discharge noise by putting a non-return valve in the discharge orifice of the atmospheric stage. Such a non-return valve closes and thus limits noise transmission when the discharge rate of the pump is low. The effectiveness of that technique is nevertheless insufficient, particularly when the pump needs to extract a non-negligible flow rate of gas, e.g. during treatment steps in the manufacture of semiconductors in a vacuum enclosure where the vacuum is created by the vacuum machine.

Proposals have also been made to reduce the discharge noise of rotary vacuum machines by adding a static attenuator with internal chambers and baffles to the discharge outlet. Nevertheless, that technique is not suitable for variations in the rate at which gas is discharged by the pump, and it presents risks of dead zones in the attenuator becoming clogged in the event of any back flow of gas suitable for producing a deposit.

It might also be thought that discharge noise could be reduced by designing a primary pump in which the atmospheric stage gives rise only to a very small drop in pressure between its inlet and its outlet. But that would require an additional stage to be added to the primary pump, which is of no advantage in obtaining and maintaining low pressure in the vacuum enclosure controlled by the vacuum machine. The only advantage of this additional stage is to reduce discharge noise, yet this additional stage is a structure that is complex and expensive since it needs to be made with the same precision qualities as a normal pump stage in the making and assembly of the complementary profiles of the two rotors that rotate relative to each other.

SUMMARY OF THE INVENTION

The problem proposed by the present invention is that of designing a new discharge noise attenuator structure for rotary vacuum machines having complementary profiles that provides effective suppression of the audible effect of discharge shockwaves, and that presents a structure that is simple, reliable, and inexpensive, having no complementary profiles or systems requiring synchronization.

The invention also seeks to provide such an attenuator which adapts effectively to variations in the rate at which gas is discharged by the pump, while also avoiding any risk of clogging.

To achieve these objects, and others, the invention provides an attenuator of discharge noise from rotary vacuum machines having a primary pump with complementary profiles, the attenuator comprising, interposed between the discharge from the primary pump and the outlet to the atmosphere, at least one transfer device having independent cavities which move sequentially between the discharge from the pump and the outlet to the atmosphere, being successively in communication with the outlet to the atmosphere, then isolated, then in communication with the discharge from the pump, then isolated, and then again in communication with the outlet to the atmosphere, and so on, so as to transfer the volume of gas discharged by the pump from the pump discharge to the outlet to the atmosphere while continuously isolating the pump discharge from the outlet to the atmosphere.

In a preferred embodiment, the cavities are made in at least one rotor rotating in a chamber of a stator having an inlet orifice putting one or more cavities into communication with the pump discharge, and an outlet orifice putting one or more other cavities into communication with the outlet to the atmosphere.

In a practical embodiment, the rotor is a disk having peripheral cavities isolated from one another and coming sequentially into register with the outlet orifice, with a solid portion of the wall of the chamber of the stator, with the outlet orifice, with another solid portion of the wall of the chamber of the stator, and again with the outlet orifice, and so on.

Preferably, the other solid portion of the wall of the chamber of the stator flares progressively so as to provide a progressive leakage gap which increases on approaching the outlet orifice. As a result, the progressive leak enables the volume of the cavity to bring its pressure slowly into equilibrium with the atmosphere by throttling the high pressure gas, the pressure already being in equilibrium when the cavity travels past the outlet orifice, thereby further reducing discharge noise.

In an advantageous embodiment, applicable to primary pumps having two coupled parallel rotors, the discharge noise attenuator comprises two rotors with parallel shafts rotating in two respective chambers of the stator and connected in parallel between a common inlet orifice and at least one outlet orifice.

In an improved embodiment, the discharge noise attenuator further comprises a bypass circuit with a non-return valve, the bypass circuit putting the inlet orifice directly into communication with the outlet orifice to the atmosphere whenever the gas pressure in the inlet orifice exceeds atmospheric pressure by a predefined pressure threshold. As a result, without reducing the efficiency of the primary pump, the attenuator makes it possible to discharge the high gas flow rate delivered by the primary pump while it is establishing a vacuum in a treatment enclosure. This enables the attenuator to be dimensioned so as to be just sufficient for evacuating the gas flow during stages of operation under steady conditions in which a vacuum is being maintained by the vacuum machine, with the bypass circuit having a non-return valve enabling surplus gas flow to pass through during transient stages in which the gas flow rate is much higher than that which can be discharged by an attenuator of such dimensions.

In a discharge noise attenuator of the invention, the cavity transfer device can be driven by the rotary vacuum machine to which it is mechanically coupled, or by an auxiliary motor. It can be placed adjacent to the discharge from the vacuum machine, or at a distance therefrom, at the outlet from a connection pipe.

The invention also provides a vacuum machine whose discharge is connected to the atmosphere via such a discharge noise attenuator as defined above.

BRIEF DESCRIPTION OF THE DRAWINGS

Other objects, characteristics, and advantages of the present invention appear from the following description of particular embodiments, given with reference to the accompanying figures, in which.

DETAILED DESCRIPTION OF THE PREFERRED EMBODIMENTS

Figure 1:
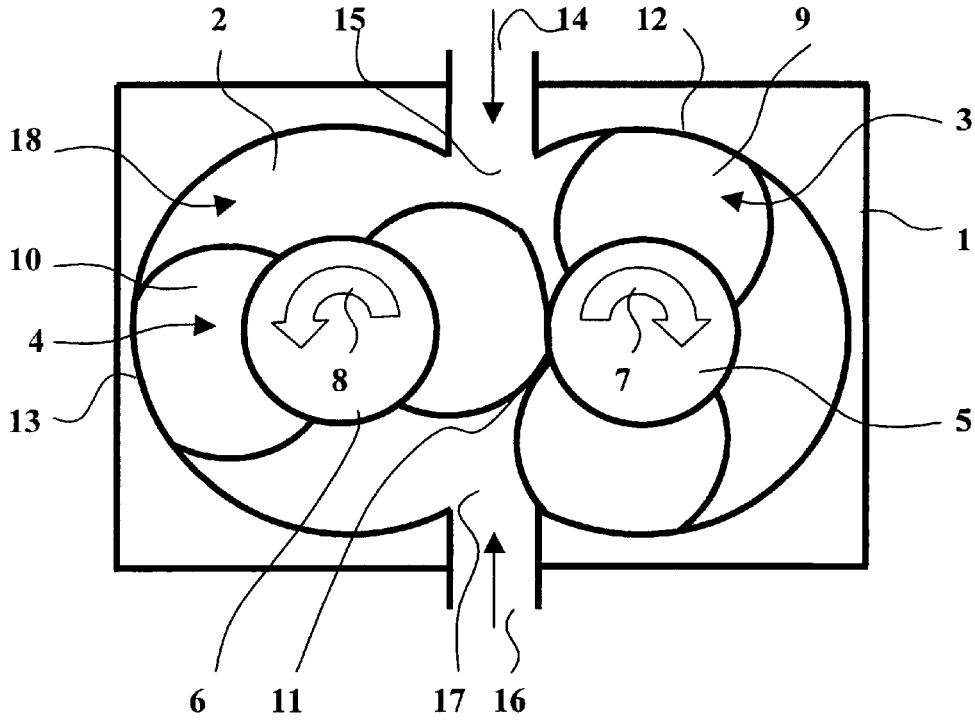
FIG. 1 is a cross-section view through the atmospheric stage of a primary pump having complementary profiles, shown in a gas discharge step.
Figure 2:
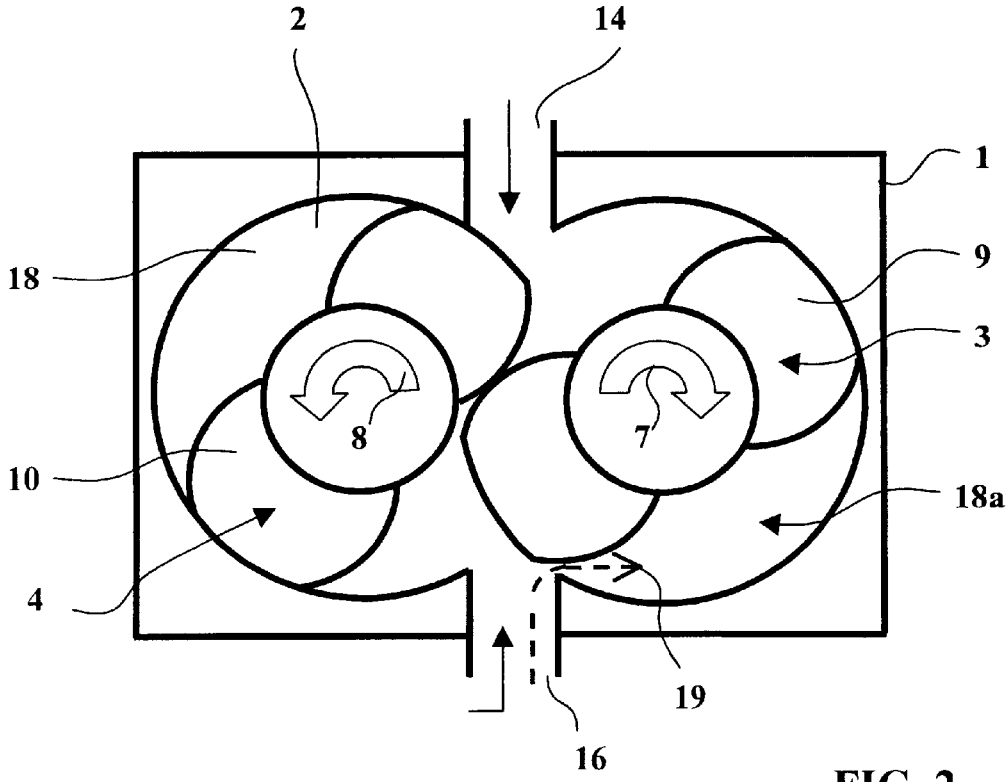
FIG. 2 is a cross-section view through the atmospheric stage of FIG. 1, in a step during which gas enters via the discharge.
Figure 3:
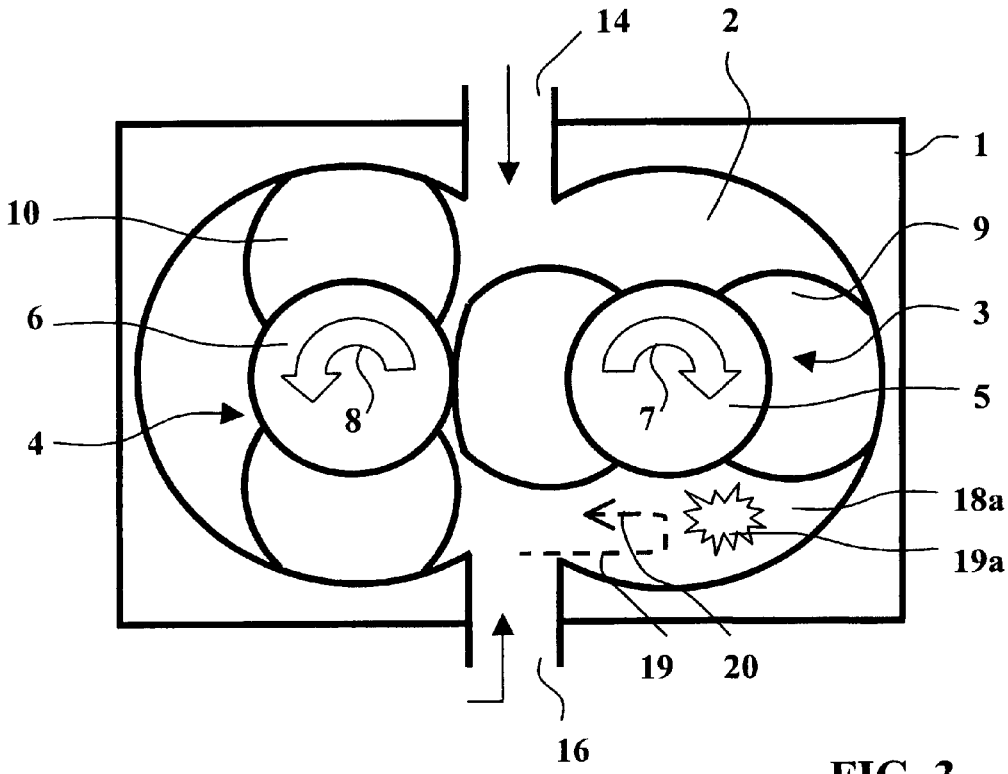
FIG. 3 is a cross-section view through the atmospheric stage of FIG. 1, at the instant of gas outlet flow reversal which gives rise to the shockwave.

Consideration is given initially to the structure of the outlet stage of a primary pump having complementary profiles, for example as shown in FIGS. 1 to 3.

The pump comprises a pump stator 1 having an inside cavity 2 with two rotors 3 and 4 turning therein on two corresponding parallel shafts 5 and 6 driven by a motor in opposite directions of rotation 7 and 8 and with appropriate relative angular positions being maintained. In the outlet or "atmospheric" stage, the rotor 3 has a lobe 9 presenting a peripheral profile that is complementary to the profile of a corresponding lobe 10 of the rotor 4 such that the lobes 9 and 10 are permanently in contact with each other via an intermediate sealing zone 11, and each of them is also in sealing contact with the wall of the pump stator 1 via respective peripheral sealing zones 12 and 13. A suction orifice 14 is in communication with a suction zone 15 of the internal cavity 2, while a discharge orifice 16 communicates with a discharge zone 17 of the internal cavity 2, and constitutes the discharge from the pump.

The pump shown in FIGS. 1 to 3 operates in the manner described below and starting from the step shown in FIG. 1. In this state, the lobe 10 of the rotor 4 has just taken a volume of gas from the suction zone 15. With continuing rotation of the rotor 4, the volume of gas 18 is held captive by the lobe 10, as shown in FIG. 2. Thereafter, with continuing rotation of the rotor 4, the volume of gas 18 is moved progressively (FIG. 2) until it comes into communication with the discharge orifice 16. The instant at which communication is established with the discharge orifice 16 is shown in FIG. 2 in association with the corresponding volume of gas 18*a* previously taken and moved by the lobe 9 of the rotor 3. At this instant, the discharge orifice 16 is theoretically at atmospheric pressure, whereas the volume of gas 18*a* is still at the suction pressure of the outlet stage of the pump, i.e. at a pressure that is much lower. A flow of gas 19 is thus sucked into the pump through the discharge orifice 16. As rotation of the rotors 3 and 4 continues, the system takes on the state shown in FIG. 3: the gas flow 19 reverses suddenly, thereby producing a shockwave 19*a*, and the gases in the volume 18*a* are then discharged by the pump, thereby producing a discharge gas flow 20 as shown in FIG. 3. It is this shockwave 19*a* and these two flows 19 and 20 that produce the discharge noise of the pump.

Figure 4:
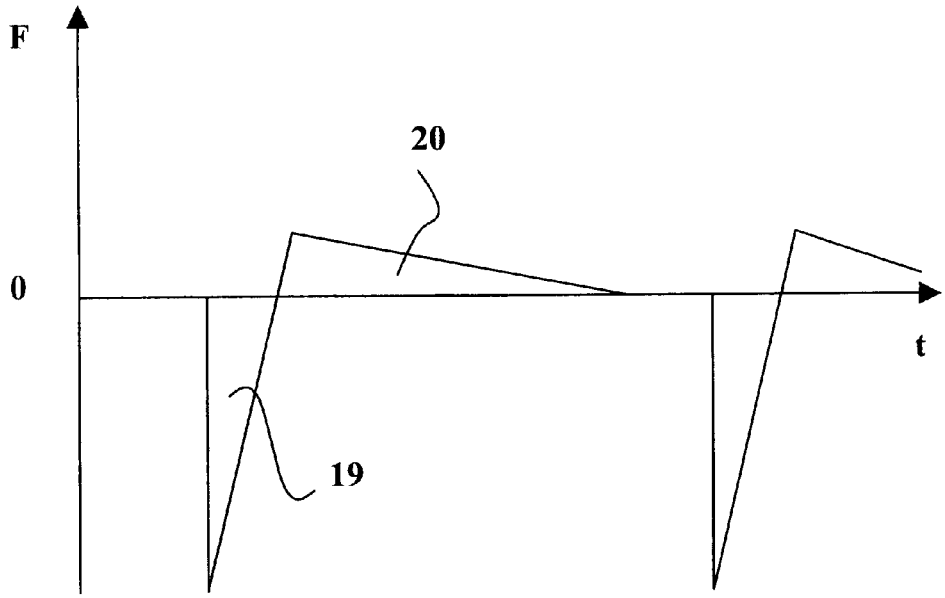
FIG. 4 is a timing diagram showing the waveform of the gas flow at the discharge from the atmospheric stage of a primary pump having complementary profiles.

FIG. 4 is a timing diagram showing the suction gas flow 19 and the discharge gas flow 20 that pass through the discharge orifice 16.

Figure 5:
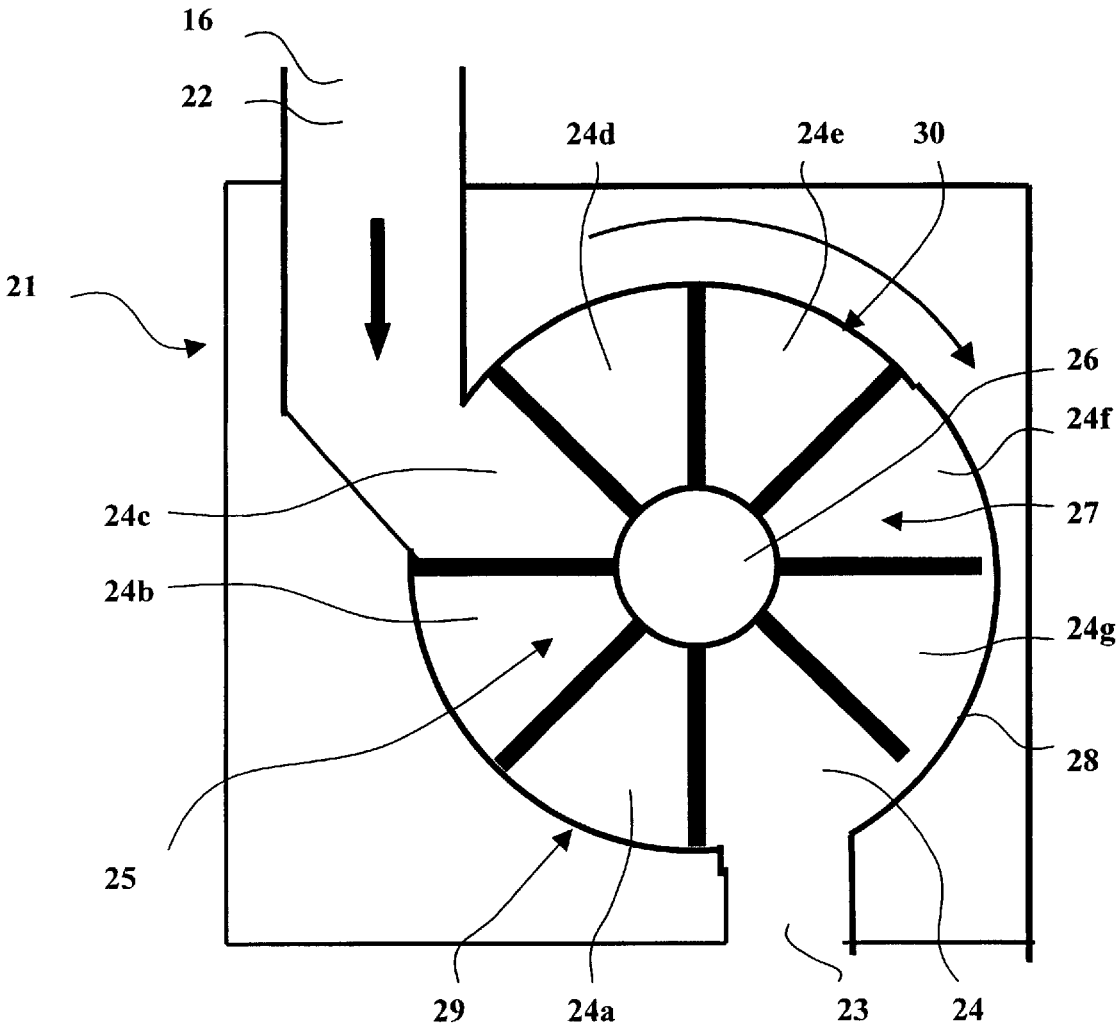
FIG. 5 is a diagrammatic cross-section view showing a dynamic noise attenuator constituting a first embodiment of the present invention.

According to the invention, the discharge noise is attenuated by means of a dynamic attenuator, a first embodiment of which is shown in FIG. 5. The discharge noise attenuator 21, as shown in FIG. 5, comprises an inlet orifice 22 which is connected to the discharge or discharge orifice 16 of the atmospheric stage of the primary pump, and it has an outlet or outlet orifice 23 connected to the surrounding atmosphere. In the discharge noise attenuator 21, a transfer device, e.g. a rotary device is interposed between the inlet orifice 22 and the outlet orifice 23, the transfer device having independent cavities such as the cavity 24 which move sequentially between the discharge or discharge orifice 16 and the outlet or outlet orifice 23, coming successively into communication with the outlet 23, then being isolated, then into communication with the discharge 16, then isolated, and then again coming into communication with the outlet 23, and so on.

In the embodiment shown in FIG. 5, the cavities such as the cavity 24 are made in a rotor 25 rotating on a shaft 26 in a cylindrical chamber 27 of a stator 28 having an inlet orifice 22 and an outlet orifice 23. The inlet orifice 22 puts one or more cavities such as the cavity 24*c* into communication with the discharge orifice 16, while the outlet orifice 23 puts one or more cavities such as the cavity 24 into communication with the atmosphere.

In the embodiment shown in FIG. 5, the rotor 25 carries eight peripheral cavities 24, 24*a*, 24*b*, 24*c*, 24*d*, 24*e*, 24*f*, and 24*g* on its shaft 26.

The rotor 25 can be a disk having peripheral cavities 24–24*g* that are isolated from one another and that come sequentially: into register with the outlet orifice 23 (such as the cavity 24 in FIG. 5), then into register with a solid portion 29 of the wall of the chamber 27 of the stator 28, and then into register with the inlet orifice 22 (such as the cavity 24*c*), and then into register with another solid portion 30 of the wall of the chamber 27 of the stator 28, before coming again into register with the outlet orifice 23, and so on. The rotor 25 with the cavities 24–24*g* constitutes the transfer device having independent cavities.

Figure 6:
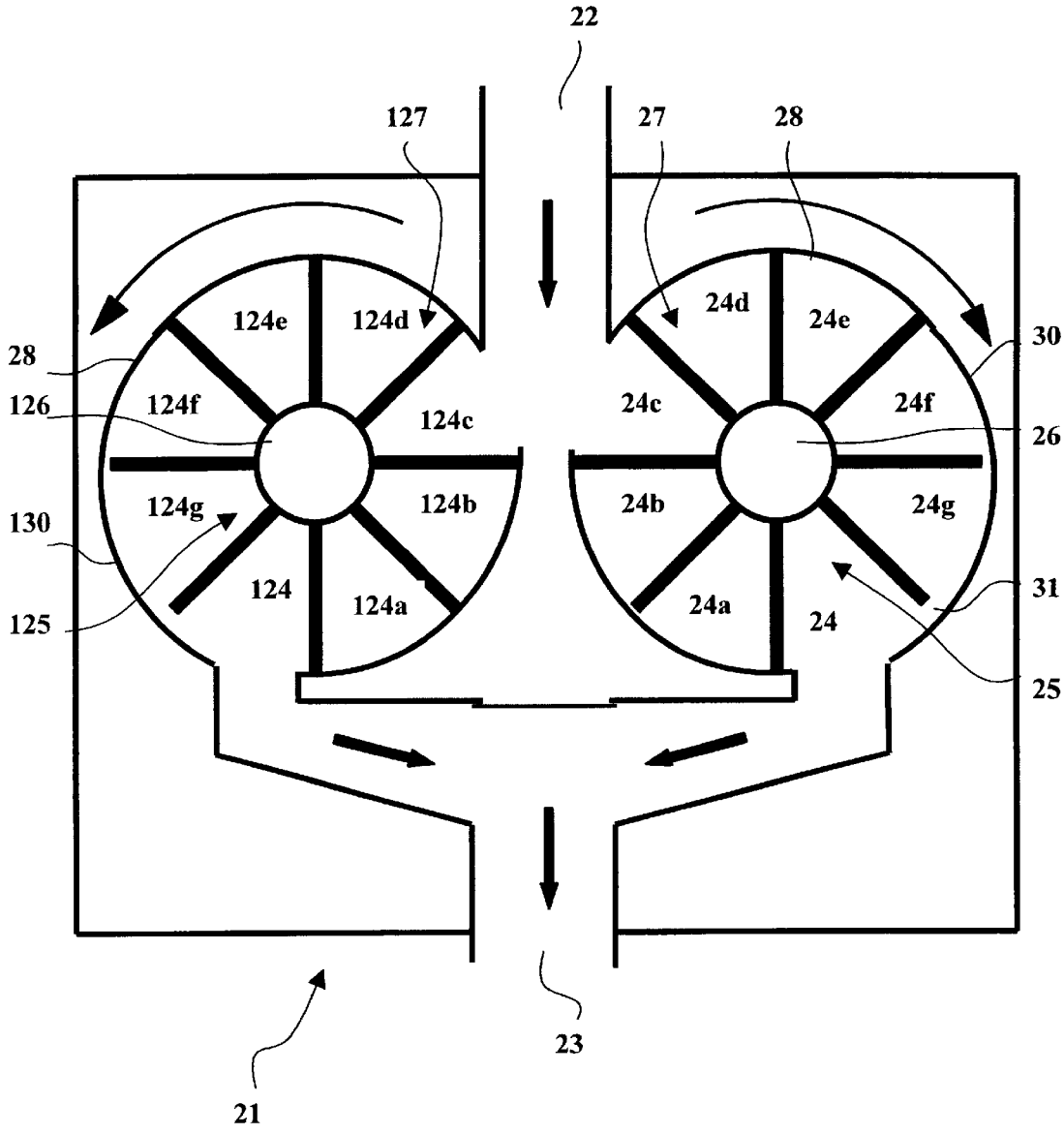
FIG. 6 is a diagrammatic cross-section view showing a dynamic attenuator of discharge noise constituting a second embodiment of the present invention.

In the embodiment shown in FIG. 6, the discharge noise attenuator 21 of the invention comprises two parallel-shaft rotors rotating in two respective chambers of the stator 28 and connected in parallel between a common inlet orifice 22 and one or two outlet orifices 23. A first chamber 27 of the stator 28 thus has the rotor 25 rotating on the shaft 26 and including the cavities 24 to 24*g*. There is also a second rotor 125, in a second chamber 127, of the stator 28 having a shaft 126 carrying cavities 124 to 124*g*. The rotors 25 and 125 and their cavities constitute two transfer devices with independent cavities.

In this embodiment, there is also shown the characteristic whereby a progressive leak is established for putting the cavities into communication with the atmosphere: over a defined sector of the said other solid portion 30 (130) of the wall of the chamber 27 (127) of the stator 28 there is a progressive flare going angularly towards the outlet orifice 23 with the chamber diameter increasing away from the shaft 26 (126) so as to establish a progressive gap 31 or leak between said solid portion 30 (130) and the walls of the cavities such as the cavities 24*f* and 24*g*, with said gap 31 increasing progressively on approaching the outlet orifice 23 in the direction of rotation of the rotors.

The volume of the cavities such as the cavities 24–24*g* is selected to be large enough to ensure that under steady conditions of the vacuum machine maintaining a vacuum, the internal gas pressure in the inlet orifice 22 (i.e. the discharge 16 from the pump) is only slightly higher than atmospheric pressure at the end of the discharge step. This ensures that the attenuator of the invention does not reduce the vacuum-creating ability of the pump.

Figure 7:
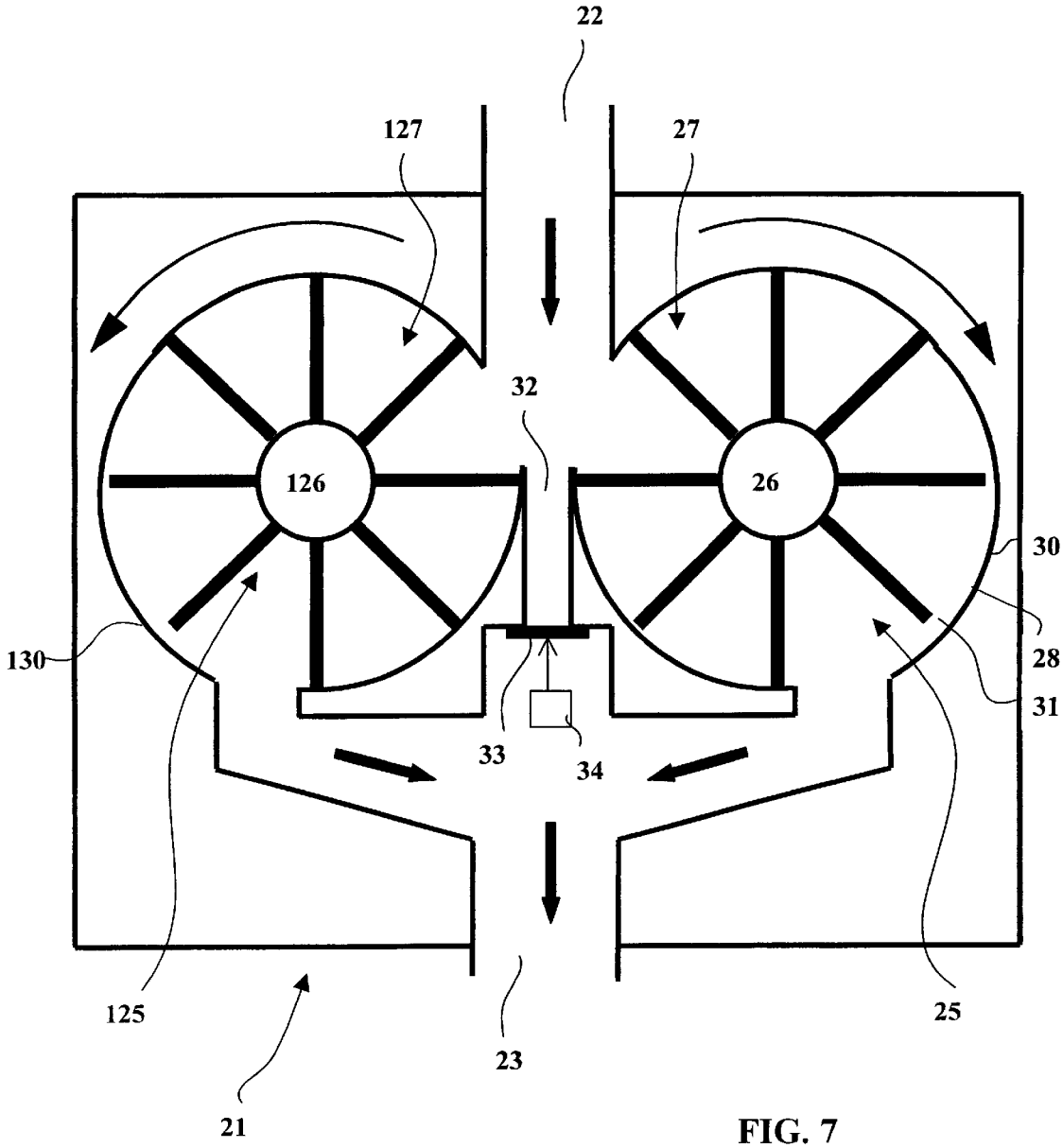
FIG. 7 is a diagrammatic cross-section view showing a discharge noise attenuator constituting a third embodiment of the present invention.

In the embodiment of FIG. 7, there can be seen the same means as those constituting the embodiment of FIG. 6, and these means are identified by the same numerical references.

However, the embodiment of FIG. 7 differs in that there is also a bypass circuit 32 having a non-return valve 33 which serves to put the inlet orifice 22 directly into communication with the outlet orifice to the atmosphere 23 in the event of the internal gas pressure inside the inlet orifice 22 exceeding atmospheric pressure beyond a predefined pressure threshold determined by rating means 34 of the non-return valve 33. As a result, if the pump discharges gas coming from the inlet orifice 22 at a rate exceeding the gas-displacement ability through the cavities 24–24*g* and 124–124*g*, then the non-return valve 33 opens and enables the surplus gas flow to be discharged directly without excessively increasing the pressure in the inlet volume of the attenuator, and thus in the outlet stage of the pump.

The cavity transfer device of the invention, e.g. the device shown in FIG. 6 or FIG. 7 comprising the rotors 25 and 125, can advantageously be driven by the rotary vacuum machine itself, being mechanically coupled thereto. For example, the shafts 26 and 126 can be constituted by the shafts 5 and 6 of the pump itself. The attenuator is then placed adjacent to the discharge 16 of the vacuum machine.

Alternatively, the attenuator can be placed at a distance from the discharge 16 of the machine, and it can be connected thereto via a connection pipe. It is also possible for the transfer device with cavities as constituted by the rotors 25 and 125 to be rotated by an auxiliary motor, possibly driven at varying speed so as to adapt to varying gas discharge rates passing through the pump.

Figure 8:
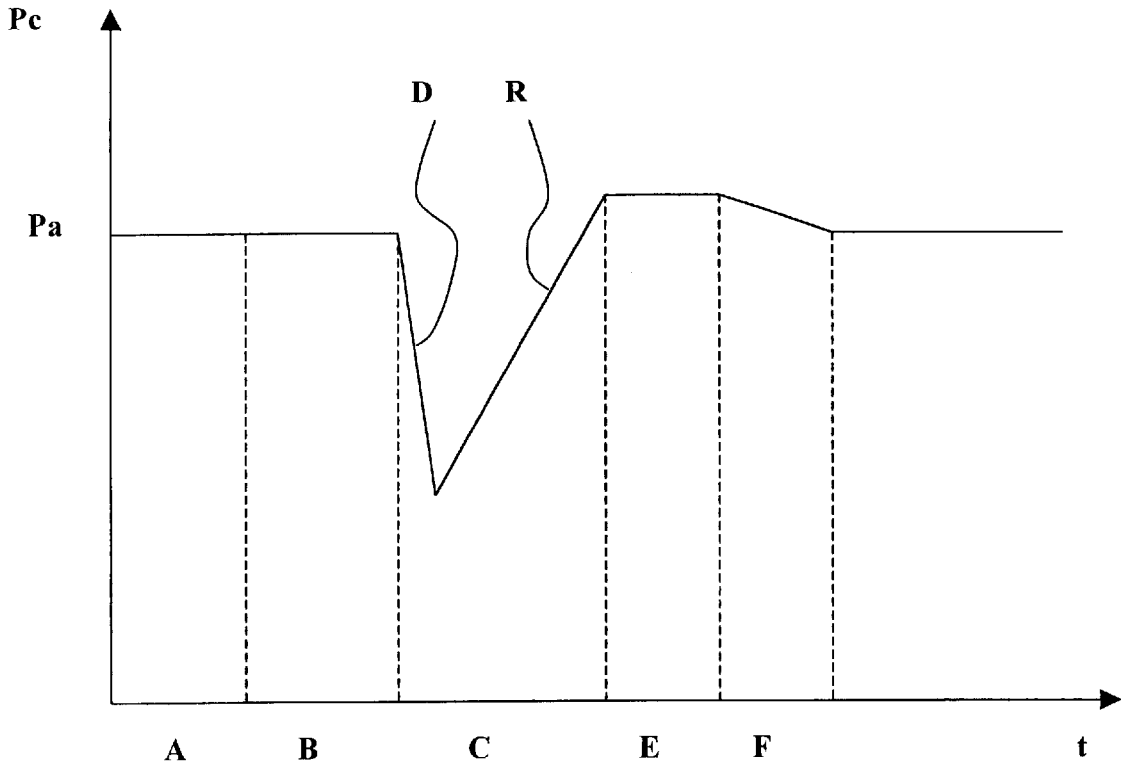
FIG. 8 is a timing diagram showing schematically the pressure waveform inside a dynamic attenuator cavity of the invention.

The effectiveness of the device of the invention is illustrated with reference to FIG. 8. This figure is a timing diagram showing the gas pressure inside a cavity such as the cavity 24 during one complete revolution of the rotor 25.

Starting from the position shown in FIGS. 5 to 7, with the cavity 24 in communication with the outlet orifice 23, the gas pressure Pc inside the cavity 24 is at atmospheric pressure Pa during a first step A. Thereafter, the cavity 24 is closed by the solid portion 29 of the wall of the chamber 27 of the stator 28, and the pressure Pc remains constant and equal to atmospheric pressure Pa through step B. Then, during step C, the cavity 24 comes into communication with the inlet orifice 22 and the discharge 16 from the pump. At this moment, or at a moment shifted thereafter, a suction flow 19 of gas can penetrate into the inside of the pump as shown in FIG. 2, thus causing the pressure to drop D inside the cavity 24, followed by a rise R in the pressure due to the flow 20 being discharged from the pump. During step E, the cavity 24 is at a pressure that is slightly higher than atmospheric pressure, and it is closed by the solid portion 30 of the wall of the chamber 27 of the stator 28. Finally, during step F, leakage takes place progressively through the gap 31, and the pressure Pc falls progressively back to atmospheric pressure Pa which then remains constant, and the cycle begins again.

It will be understood that because the cavity 24*c* communicating with the discharge 16 of the pump is isolated from the outside atmosphere by the sealing across the walls of the other chambers, the shockwave produced during step C is not transmitted to the outside atmosphere, so the noise is confined within the inlet compartment of the noise attenuator.

The invention is not limited to the embodiments described in particular, and it includes any variants and generalizations which are within the competence of the person skilled in the art.

What is claimed is:

1. A discharge noise attenuator for rotary vacuum machines having a primary pump with complementary profiles, the attenuator comprising, interposed between a discharge from the primary pump and an outlet to atmosphere, at least one transfer device having independent cavities of constant volume which move sequentially between the discharge from the pump and the outlet to the atmosphere, being successively in communication with the outlet to the atmosphere, then isolated, then in communication with the discharge from the pump, then isolated, and then again in communication with the outlet to the atmosphere, and so on, so as to transfer a volume of gas discharged by the pump from the pump discharge to the outlet to the atmosphere while continuously isolating the pump discharge from the outlet to the atmosphere.

2. A discharge noise attenuator according to claim 1, wherein the cavities are made in at least one rotor rotating in a chamber of a stator having an inlet orifice putting one or more cavities into communication with the pump discharge, and an outlet orifice putting one or more other cavities into communication with the outlet to the atmosphere.

3. A discharge noise attenuator according to claim 2, wherein the rotor is a disk having peripheral cavities isolated from one another and coming sequentially into register with the outlet orifice, with a solid portion of the wall of the chamber of the stator, with the outlet orifice, with another solid portion of the wall of the chamber of the stator, and again with the outlet orifice, and so on.

4. A discharge noise attenuator according to claim 3, wherein the other solid portion of the wall of the chamber of the stator flares progressively so as to provide a progressive leakage gap which increases on approaching the outlet orifice.

5. A discharge noise attenuator according to claim 1, wherein the transfer device having cavities is rotated by a rotary vacuum machine to which it is mechanically coupled.

6. A discharge noise attenuator according to claim 1, wherein the transfer device with cavities is driven by an auxiliary motor.

7. A discharge noise attenuator according to claim 5, the attenuator being placed adjacent to the discharge from the vacuum machine.

8. A discharge noise attenuator according to claim 5, the attenuator being placed at a distance from the discharge of the vacuum machine, and is connected thereto by a connection pipe.

9. The discharge noise attenuator according to claim 1, wherein the primary pump comprises dual rotors rotatable inside a pump cavity having a discharge orifice (16) which fluidly couples the discharge from the primary pump to an inlet orifice (22) of the transfer device.

10. A discharge noise attenuator for rotary vacuum machines having a primary pump with complementary profiles, the attenuator comprising, interposed between the discharge from the primary pump and an outlet to atmosphere, at least one transfer device having independent cavities which move sequentially between the discharge from the pump and the outlet to the atmosphere, being successively in communication with the outlet to the atmosphere, then isolated, then in communication with the discharge from the pump, then isolated, and then again in communication with the outlet to the atmosphere, and so on, so as to transfer a volume of gas discharged by the pump from the pump discharge to the outlet to the atmosphere while continuously isolating the pump discharge from the outlet to the atmosphere, said at least one transfer device having two rotors with parallel shafts rotating in two respective chambers of a stator and connected in parallel between a common inlet orifice and at least one outlet orifice.

11. A discharge noise attenuator for rotary vacuum machines having a primary pump with complementary profiles, the attenuator comprising, interposed between the discharge from the primary pump and outlet to atmosphere, at least one transfer device having independent cavities which move sequentially between the discharge from the pump and the outlet to the atmosphere, being successively in communication with the outlet to the atmosphere, then isolated, then in communication with the discharge from the pump, then isolated, and then again in communication with the outlet to the atmosphere, and so on, so as to transfer a volume of gas discharged by the pump from the pump discharge to the outlet to the atmosphere while continuously isolating the pump discharge from the outlet to the atmosphere; and wherein the cavities are of a volume that is selected to be large enough to ensure that, during steady conditions in which a vacuum machine connected to the discharge noise attenuator maintains a vacuum, an internal gas pressure in an inlet orifice of the discharge noise attenuator is only slightly greater than an atmospheric pressure to which the volume of gas is discharged.

12. A discharge noise attenuator for rotary vacuum machines having a primary pump with complementary profiles, the attenuator comprising, interposed between a discharge from the primary pump and an outlet to atmosphere, at least one transfer device having independent cavities which move sequentially between the discharge from the pump and the outlet to the atmosphere, being successively in communication with the outlet to the atmosphere, then isolated, then in communication with the discharge from the pump, then isolated, and then again in communication with the outlet to the atmosphere, and so on, so as to transfer a volume of gas discharged by the pump from the pump discharge to the outlet to the atmosphere while continuously isolating the pump discharge from the outlet to the atmosphere; and having a bypass circuit with a non-return valve, the bypass circuit putting an inlet orifice directly into communication with an outlet orifice to the atmosphere whenever a gas pressure in the inlet orifice exceeds atmospheric pressure by a predefined pressure threshold.

13. A vacuum machine, wherein its discharge is connected to the atmosphere via a discharge noise attenuator, having a primary pump with complementary profiles, the attenuator comprising, interposed between a discharge from the primary pump and an outlet to atmosphere, at least one transfer device having independent cavities of constant volume which move sequentially between the discharge from the pump and the outlet to the atmosphere, being successively in communication with the outlet to the atmosphere, then isolated, then in communication with the discharge from the pump, then isolated, and then again in communication with the outlet to the atmosphere, and so on, so as to transfer a volume of gas discharged by the pump from the pump discharge to the outlet to the atmosphere while continuously isolating the pump discharge from the outlet to the atmosphere.

14. The vacuum machine according to claim 13, wherein the primary pump comprises dual rotors rotatable inside a pump cavity having a discharge orifice (16) which fluidly couples the discharge from the primary pump to the transfer device.

* * * * *